US006971624B2

(12) United States Patent
Kollar et al.

(10) Patent No.: US 6,971,624 B2
(45) Date of Patent: Dec. 6, 2005

(54) ADJUSTABLE SUPPORT FOR DATA ENTRY/INTERFACE DEVICE

(75) Inventors: Kevin J Kollar, Ada, MI (US); John P. Conner, Grandville, MI (US)

(73) Assignee: Knape & Vogt Manufacturing Co., Grand Rapids, MI (US)

( * ) Notice: Subject to any disclaimer, the term of this patent is extended or adjusted under 35 U.S.C. 154(b) by 0 days.

(21) Appl. No.: 10/695,146

(22) Filed: Oct. 28, 2003

(65) Prior Publication Data

US 2004/0195482 A1 Oct. 7, 2004

Related U.S. Application Data

(60) Provisional application No. 60/422,287, filed on Oct. 30, 2002.

(51) Int. Cl.[7] ..... E04G 3/00

(52) U.S. Cl. ..... 248/918; 248/346.01; 248/274.1; 248/284.1; 108/137

(58) Field of Search ..... 248/918, 118.1, 248/346.01, 274.1, 276.1, 281.11, 118; 108/69, 108/75, 137, 138; 312/208.1, 223.3

(56) References Cited

U.S. PATENT DOCUMENTS

| | | | | |
|---|---|---|---|---|
| 651,539 | A | 6/1900 | Warren | |
| 719,625 | A | 2/1903 | Throm | |
| 1,982,954 | A | 12/1934 | Grobe | |
| 4,381,714 | A | 5/1983 | Henneberg et al. | 108/147 |
| 4,616,798 | A | 10/1986 | Smeenge et al. | 248/281.1 |
| 4,632,349 | A | 12/1986 | Anstey | 248/281.1 |
| 4,691,888 | A | 9/1987 | Cotterill | 248/284 |
| 4,706,919 | A | 11/1987 | Soberalski et al. | 248/281.1 |
| 4,747,353 | A | 5/1988 | Watt | 108/146 |
| 4,776,284 | A * | 10/1988 | McIntosh | 108/138 |
| 4,826,123 | A | 5/1989 | Hannah et al. | 248/248 |
| 4,834,329 | A | 5/1989 | Delapp | 248/183 |
| 4,883,316 | A | 11/1989 | Austin, Jr. et al. | 297/191 |
| 4,974,808 | A | 12/1990 | Ball | 248/917 |
| 4,976,407 | A | 12/1990 | Schwartz et al. | 248/118.3 |
| 5,022,137 | A | 6/1991 | Sorensen et al. | 29/559 |
| 5,037,054 | A | 8/1991 | McConnell | 248/284 |

(Continued)

FOREIGN PATENT DOCUMENTS

| | | |
|---|---|---|
| DE | 2847135 | 10/1978 |

(Continued)

*Primary Examiner*—Robert P. Olszewski
*Assistant Examiner*—Steven Marsh
(74) *Attorney, Agent, or Firm*—Mayer, Brown, Rowe & Maw LLP

(57) ABSTRACT

An adjustable support assembly for a data entry/interface device for computers or the like such as a keyboard, keypad, laptop/notebook computer, personal data/digital assistant, tablet PC, trackball or the like provides selective adjustment of both height and angular orientation or tilt for the data entry/interface device with respect to the work surface on which it is mounted. A pair of actuator handles are pivotally mounted in close proximity to one another on a data entry/interface mount to allow either independent or simultaneous operation with one hand by the device operator to control height and/or tilt. The actuator handles are connected to individual adjustment clamp assemblies by separate flexible cable actuators. Depression of each actuator handle pivots at least one clamp bar connected to the cable actuator between clamping and release positions to lock or allow reciprocation of a rigid adjustment bar extending through an aperture in the clamp bar. The adjustment bars are connected to the data entry/interface mount or linkage assembly to thereby resist or allow height and/or tilt adjustment.

24 Claims, 11 Drawing Sheets

U.S. PATENT DOCUMENTS

| | | | | | |
|---|---|---|---|---|---|
| 5,048,784 | A | | 9/1991 | Schwartz et al. | 248/244 |
| 5,145,136 | A | * | 9/1992 | McConnell | 248/284.1 |
| 5,211,367 | A | | 5/1993 | Musculus | 248/279 |
| 5,257,767 | A | | 11/1993 | McConnell | 248/284 |
| 5,292,097 | A | | 3/1994 | Russell | 248/281.1 |
| 5,294,087 | A | | 3/1994 | Drabczyk et al. | 248/639 |
| 5,398,622 | A | | 3/1995 | Lubinskas et al. | 108/145 |
| 5,418,567 | A | | 5/1995 | Boers et al. | 348/375 |
| 5,487,525 | A | | 1/1996 | Drabczyk et al. | 248/639 |
| 5,564,667 | A | | 10/1996 | Copeland et al. | 248/278.1 |
| 5,704,299 | A | | 1/1998 | Corpuz, Jr. et al. | 108/50 |
| 5,730,408 | A | | 3/1998 | McAllister et al. | 248/288.51 |
| 5,775,657 | A | | 7/1998 | Hung | 248/289.11 |
| 5,791,263 | A | * | 8/1998 | Watt et al. | 108/138 |
| 5,832,840 | A | | 11/1998 | Woof | 108/6 |
| 5,836,560 | A | | 11/1998 | Kaplan et al. | 248/286.1 |
| 5,878,674 | A | * | 3/1999 | Allan | 108/93 |
| 5,881,984 | A | * | 3/1999 | Lin | 248/284.1 |
| 5,924,664 | A | | 7/1999 | Mileos et al. | 248/281.11 |
| 5,927,662 | A | | 7/1999 | West et al. | 248/118 |
| 5,967,479 | A | * | 10/1999 | Sweere et al. | 248/280.11 |
| 5,975,474 | A | | 11/1999 | Kaplan et al. | 248/289.11 |
| 6,019,332 | A | | 2/2000 | Sweere et al. | 248/284.1 |
| 6,092,774 | A | | 7/2000 | Choy | 248/298.1 |
| 6,098,935 | A | * | 8/2000 | Kaplan et al. | 248/118.1 |
| 6,186,460 | B1 | * | 2/2001 | Lin | 248/284.1 |
| 6,244,547 | B1 | | 6/2001 | Tonizzo et al. | 248/118.3 |
| 6,279,859 | B2 | * | 8/2001 | West et al. | 248/118 |
| 6,322,031 | B1 | | 11/2001 | LeClair et al. | 248/286.1 |
| 6,343,775 | B1 | * | 2/2002 | Jones et al. | 248/284.1 |
| 6,409,127 | B1 | | 6/2002 | VanderHeide et al. | 248/118 |

FOREIGN PATENT DOCUMENTS

| | | | |
|---|---|---|---|
| GB | 2176996 | A | 1/1987 |
| JP | 6076428 | | 4/1985 |
| JP | 6077426 | | 5/1985 |
| JP | 6095036 | | 5/1985 |
| JP | 60163040 | | 8/1985 |
| JP | 60180029 | | 9/1985 |

* cited by examiner

D
80
82
84
86
92
94
100
102
104
106
114
118
118a
118b
120
120a
120b
120, 120a, 120b
122
122a
122b
124
126
128
130
132
132a
132b
136
138
140
150
152
154
156
158
160
162
164
170
172
174
176
178
186
187
188
189
190
192
194
196
198
200
202
204
206
207
208
209
210
212

ADJUSTABLE SUPPORT FOR DATA ENTRY/INTERFACE DEVICE

CROSS REFERENCE TO RELATED APPLICATION

This application claims priority from U.S. provisional patent application Ser. No. 60/422,287, filed Oct. 30, 2002, the disclosure of which is hereby incorporated by reference herein.

FIELD OF THE INVENTION

The present invention relates to adjustable supports for attachment to a work surface for adjustably supporting a data entry/interface device such as a keyboard for a computer or the like adjacent to a computer and/or computer screen on the work surface. More particularly, this invention relates to an adjustable support assembly for selective adjustment of both the height and angular orientation or tilt of the data entry/interface device with respect to the work surface on which it is supported.

BACKGROUND OF THE INVENTION

It is widely known to use a support mechanism to support a computer keyboard or other data entry/interface device on the under side of a work surface adjacent to a computer screen. Such mechanisms allow the keyboard or similar device to be adjusted for both height and/or angular orientation with respect to the work surface and the user of the keyboard or similar device for ease of use, and also provide for movement to a storage position under the work surface so that the keyboard or other data entry/interface device is moved out of the way for other tasks at the work surface when the computer is not in use.

One form of a keyboard support is shown in Smeenge et al. U.S. Pat. No. 4,616,798 which discloses an adjustable assembly for the supporting keyboards relying on a linkage system that may be fixed in position by a locking mechanism which incorporates a rotatable knob for tightening and loosening a screw-type, threaded clamp. Smeenge et al. teaches a keyboard support mechanism that is adjustable for height and which, in certain embodiments, can also swivel to increase ergonomic utility for keyboard users.

An improvement over Smeenge et al. U.S. Pat. No. 4,616,798 is shown in VanderHeide et al. U.S. Pat. No. 6,409,127. VanderHeide et al. provides a keyboard support allowing adjustment of both the height and angular tilt or orientation of the keyboard along with a convenient means for locking the apparatus in a desired position. VanderHeide et al. relies on a leaf spring assembly to provide a clamping force controlling both the height and tilt angle adjustment by means of a single adjustment handle.

Another type of keyboard support mechanism is shown in West et al. U.S. Pat. No. 6,279,859 which includes separate brake assemblies connected by means of flexible cables to a single L-shaped actuator lever which is pivotable inwardly to one of two actuating positions. When the actuator lever is pushed inwardly a first predetermined distance, the angular tilt or orientation of the keyboard support mechanism can be adjusted since one of the two cable connectors is activated to release one of the two brake mechanisms. Further movement of the actuator lever inwardly to a second actuating position actuates the second cable and brake to allow vertical height adjustment of the keyboard support with respect to the work surface. Thus, pivoting a single lever a greater or lesser amount serves to release one or both of the brakes to allow both height and tilt adjustment of the keyboard support pad. West et al. U.S. Pat. No. 6,279,859 also discloses another embodiment in which both brake mechanisms may be released upon a single actuating movement of the actuator lever so that both angular orientation or tilt as well as vertical height of the keyboard can be adjusted simultaneously with one lever.

Other keyboard adjustment mechanisms are also known. One of these includes the use of pressurized cylinders to position a keyboard tray for both tilt and height adjustment. Such devices have a limited range of adjustment for height and have a potential for loss of cylinder pressure over time necessitating repair and/or replacement of the expensive pressurized components. In addition, such assembles are considerably more expensive due to the higher cost of these components.

While these assemblies have worked adequately for their intended purposes, each provides certain disadvantages when operation of the prior adjustable keyboard support is desired. Operation of the keyboard adjustment mechanisms using manual, rotatable, screw-type clamps is both inconvenient and time consuming thereby detracting from the ability to make quick or precise adjustments in the keyboard position especially using one hand. Those mechanisms using a single control lever do not provide for selective adjustment of either angular orientation or tilt or the height of the keyboard support independently of one another, and/or require very careful and controlled depression of a single actuator to avoid release of two brakes controlling both tilt and height simultaneously. More recent demands for keyboard supports have illustrated the need for independent, rapid and precise control of either the height or angular tilt of the keyboard support in an efficient manner without requiring both adjustments to be made at the same time. Likewise, because of the demands on many keyboard operators, the need for highly accessible, independent control of the height and tilt adjustments has been needed. The present invention provides a solution for these needs by including separately operable, independent controls which may be actuated with one hand by an operator of a keyboard or other data entry/interface device to control both angular tilt and height independently. In addition, the independent controls are positioned such that both may be engaged and quickly and efficiently operated simultaneously with one hand by a user of a keyboard or other data entry/interface device in the event simultaneous height and tilt adjustments are desired.

SUMMARY OF THE INVENTION

Accordingly, the present invention provides an adjustable support assembly for attachment to a work surface to support a data entry/interface device for computers or the like such as a keyboard, keypad, laptop, notebook computer, personal data/digital assistant, tablet PC, trackball or the like, and which includes separate, independent actuator handles connected to clamp members which allow the release and adjustment of both the angular orientation or tilt and height of the support with respect to the work surface using one hand. In addition, the actuator handles are positioned such that, if simultaneous actuation of both tilt and height adjustment is desired, the handles may be actuated simultaneously with one hand by the user of the data entry/interface device.

In one form of the invention, an adjustable support assembly is provided for attachment to work surface to support a data entry/interface device for computers or the like such as a keyboard, keypad, laptop, notebook computer, personal data/digital assistant, tablet PC, trackball or the like. The support assembly includes a data entry/interface mount for engaging and supporting a data entry/interface device for computers or the like, a work surface mount for attachment to a work surface, and a linkage assembly for adjustably connecting the data entry/interface mount to the work surface mount. An adjustment assembly is included for adjusting the height and angular tilt positions of the data entry/interface mount on the linkage assembly. The adjustment assembly includes a pair of actuator handles mounted on the data entry/interface mount, and a pair of release assemblies also mounted on the data entry/interface mount. One handle is moveable for operation of one of the release assemblies to adjust the height of the data entry/interface mount, while the other handle is moveable for operation of the other release assembly to adjust the angular tilt of the data entry/interface mount. Preferably, the actuator handles are mounted in close proximity to one another such that a user of the support assembly can engage and move one or both of the handles with one hand for adjustment of one or both of the height and angular tilt of the data entry/interface mount as desired. At least one, and preferably both, of the actuator handles is connected to its respective release assembly by a flexible cable allowing location of the release mechanisms at convenient positions for use.

In another form of the invention, an adjustable support assembly is provided for a data entry/interface device for computers or the like such as a keyboard, keypad, laptop, notebook computer, personal data/digital assistant, tablet PC, trackball or the like, including a data entry/interface mount for engaging and supporting a keyboard or other data entry/interface device for computers or the like, a work surface mount for attachment to a work surface, and a linkage assembly for adjustably connecting the data entry/interface mount to the work surface mount. This form of the invention also includes a first adjustment assembly having engaged and release positions such that the height of the data entry/interface mount on the linkage assembly may be adjusted with respect to the work surface mount when in the release position. A first handle is movably mounted on the data entry/interface mount for access and movement by a user of the data entry/interface device when a keyboard or other data entry/interface device is mounted on the data entry/interface mount. A first cable actuator is coupled between the first handle and the first adjustment assembly, the first cable actuator actuating the first adjustment assembly from the engaged to the release position allowing adjustment of the height of the data entry/interface mount when the first handle is moved by the user. A second adjustment assembly has engaged and release positions such that the angular tilt of the data entry/interface mount on the linkage assembly may be adjusted with respect to the work surface mount when in the release position. A second handle is moveably mounted on data entry/interface mount separate and independent from the first handle for access and movement by a user when a data entry/interface device is mounted on the data entry/interface mount. A second cable actuator is coupled between the second handle and the second adjustment assembly. The second cable actuator actuates the second adjustment assembly from the engaged to the release position and allows adjustment of the angular tilt of the data entry/interface mount when the second handle is moved by the user.

In a preferred embodiment of the support assembly, the first adjustment assembly includes a first adjustment member coupled to one portion of the linkage assembly and a first clamp member mounted on one of the data entry/interface mount and the linkage assembly and engaging the first adjustment member. The first cable actuator is connected to the first clamp member for movement of the first clamp member between a clamping and release positions upon movement of the first handle. The first clamp member resists movement of the first adjustment member in at least one direction to resist a change in height of the data entry/interface mount when in the clamping position.

This embodiment also preferably includes a second adjustment assembly having a second adjustment member coupled to one portion of the data entry/interface mount and at least one second clamp member moveably mounted on a portion of the linkage assembly and engaging the second adjustment member. The second cable actuator is connected to the second clamp member for movement of the second clamp member between a clamping and release positions upon movement of the second handle. The second clamp member resists movement of the second adjustment member in at least one direction to resist a change in the angular tilt of the data entry/interface mount when in the clamping position.

In other aspects of the invention, the second adjustment assembly may include a pair of second clamp members, each moveably mounted on a portion of the linkage assembly and engaging the second adjustment member. The second cable actuator is connected to both of the second clamp members such that the second clamp members are each moveable between respective clamping and release positions simultaneously upon movement of the second handle. The pair of second clamp members resists movement of the second adjustment member in two directions to resist changes in angular tilt of the data entry/interface mount when in the respective clamping positions.

In yet other aspects, the first and second clamp members are mounted on the same portion of the linkage assembly, preferably in respective first and second clamp housings. The first and second clamp housings are preferably pivotally mounted on the same linkage assembly portion.

Further, each of the first and second clamp housing may include a spring engaging the respective first and second clamp members. Each spring urges its respective first clamp member or second clamp member to the respective clamping position. In addition, the first and second handles may each include a handle spring engaging the data entry/interface mount urging the handles toward their respective clamp positions. Preferably, the handles are molded from a polymeric material for strength and weight reduction while the handle spring on each is molded integrally therewith from the polymeric material.

In further aspects of the invention, the first and second handles are each pivotally mounted on the data entry/interface mount and are elongated to increase the mechanical advantage of the user for releasing the respective clamp members for adjustment. Each of the first and second clamp housings may include an aperture for receipt of the respective first and second adjustment members passing therethrough.

In addition, in a preferred embodiment, the first and second clamp members each include an aperture therethrough with the respective first and second adjustment members passing through the aperture in their respective first and second clamp members.

In a further embodiment of the invention, an adjustable support assembly provides a data entry/interface mount for engaging and supporting a data entry/interface device for computers of the like, a work surface mount adapted to be coupled to a work surface, and a linkage assembly having one end coupled to the work surface mount and an opposite end coupled to the data entry/interface mount. A first adjustment member has an axis of elongation and is coupled to one of the data entry/interface mount and the linkage assembly and is adapted to move with said one of said data entry/interface mount and said linkage assembly upon movement thereof. The first clamp member is mounted on the other of the linkage assembly and data entry/interface mount and defines a first clamp opening. The first adjustment member is received in the first clamp opening while the first clamp member has a clamped position in which the first clamp member is in clamped engagement with the first adjustment member and resists movement thereof. The first clamp member has a release position shifted from the clamped position and in which the first adjustment member is moveable relative to the first clamp member. A first actuator assembly is coupled to the first clamp member to selectively shift the first clamp member between the clamped position and release position.

In preferred embodiments, the first actuator mechanism may include a first flexible cable coupled between the first handle and the first clamp member. At least one spring may be included for urging the first cable and first clamp member toward the clamped position. In one form, the spring engages the first clamp member. In another form, the spring extends between the first handle and the data entry/interface mount. In a preferred embodiment, at least two springs are provided, a first spring engaging the first clamp member, and a second spring extending between the first handle and the data entry/interface mount.

The various embodiments of this invention allow either independent control of the height and tilt of the data entry/interface mount and support by conveniently positioned actuating handles easily engaged with a single hand by the user. However, the handles are positioned in close proximity to one another such that both may be engaged by the same hand of the user for simultaneous height and tilt control, if desired.

These and other objects, advantages, purposes and features of the invention will become more apparent from a study of the following description taken in conjunction with the drawings.

DESCRIPTION OF THE PREFERRED EMBODIMENTS

Figure 1:
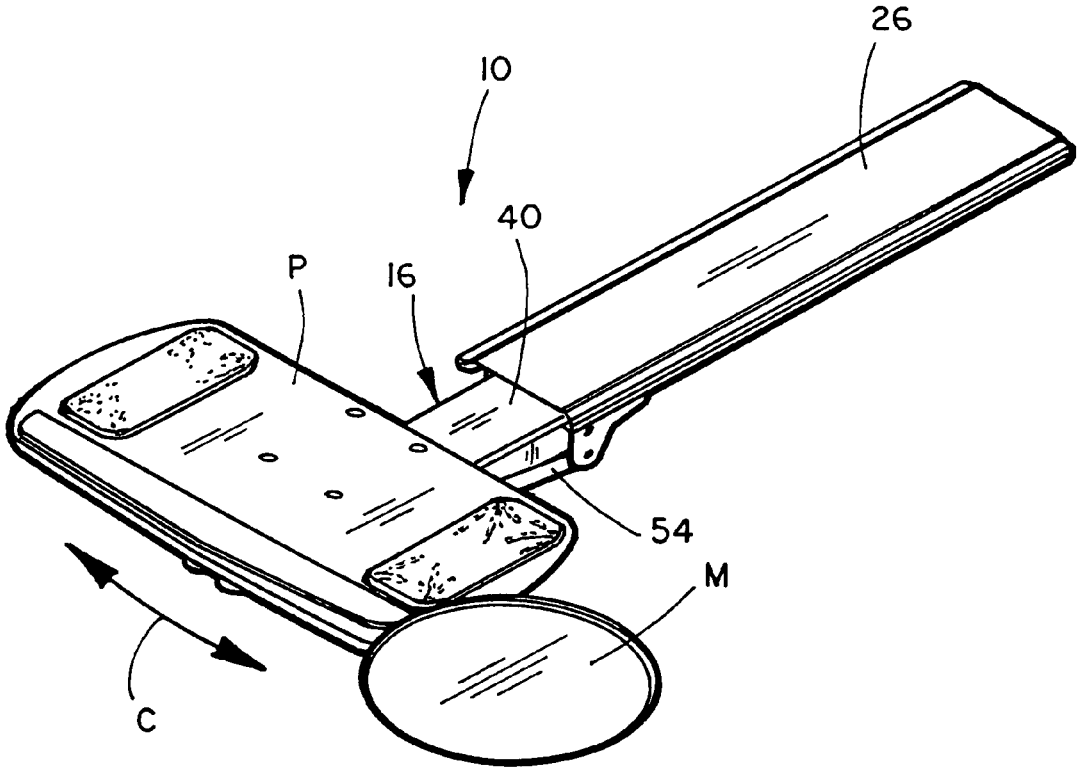
FIG. 1 is a perspective view of the adjustable support assembly of the present invention including a data entry/interface support pad and an optional mouse support pad secured thereto.

Referring now to the drawings in greater detail, an adjustable support assembly 10 is shown in FIGS. 1–8 and is adapted for attachment to a work surface such as a desk, credenza, shelf or the like to support a keyboard or other data/entry interface device for a computer or the like in a position adjacent to a computer, computational device, microprocessor, CPU (central processing unit) for a computer, or the like or a computer monitor or screen for use by the user of the data entry/interface device. The adjustable support assembly 10 provides the ability to change the height of the support for the data entry/interface device with respect to the work surface W so that a keyboard or other data entry/interface device (not shown) mounted on a support pad P, which may include an auxiliary mouse support pad M, may be raised and lowered in the directions shown by arrows A in FIG. 2 to accommodate the height of a user sitting adjacent thereto, while the angular orientation or tilt of the support pad P may be changed by rotation as shown by arrows B in FIG. 2.

As used herein interface device or data entry/interface device shall be understood to include devices used by operators to input data, control or otherwise interact with a computer, PC (personal computer), computational device, microprocessor, CPU (central processing unit) for a computer, or the like. Such interface or data entry/interface devices include, for example, keyboards, keypads, laptop/notebook computers, PDA's (personal data/digital assistant), tablet PC's (personal computers), trackball controls or trackballs, or the like.

In a preferred embodiment, adjustable support assembly 10 includes a swivel assembly 12 enabling the keyboard or other data entry/interface device to be pivoted in the directions shown by arrow C in FIG. 1, mount 14 for a keyboard or other data entry/interface device as explained above, hereinafter referred to as a data entry/interface mount, to which a support pad P for supporting a keyboard or other data entry/interface device is adapted to be secured as shown in FIGS. 1–4, a linkage assembly 16 which connects swivel assembly 12 to data entry/interface mount 14, and an adjustment assembly 18 mounted beneath data entry/interface mount 14 and linkage assembly 16 and connected between the data entry/interface mount and linkage assembly as described more fully below.

Figure 2:
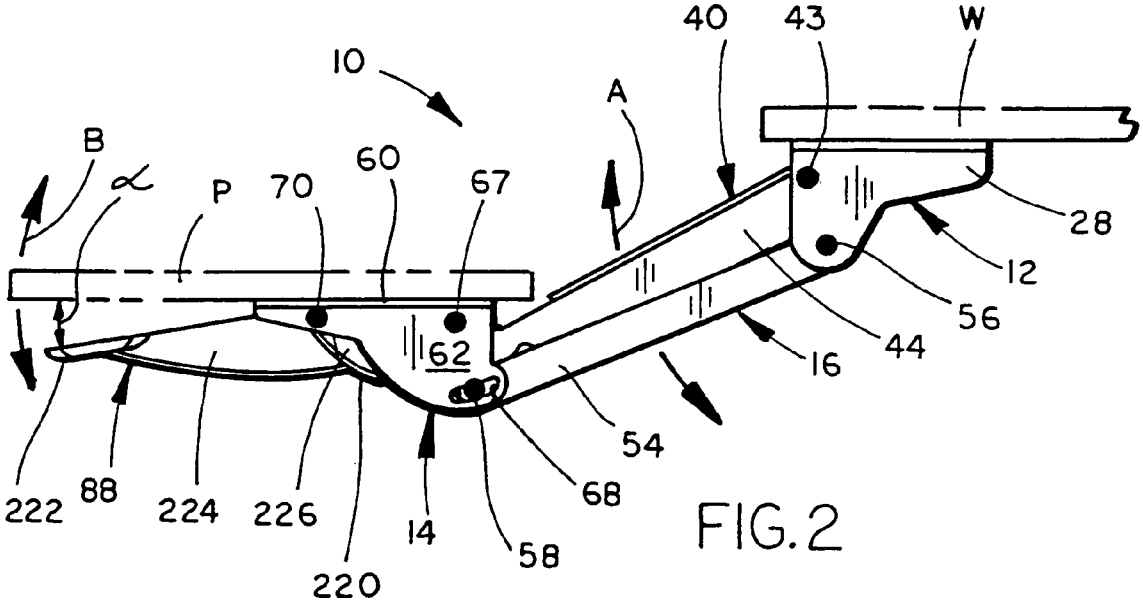
FIG. 2 is a side elevation of the adjustable support assembly of the present invention when secured to the underside of a work surface and supporting a data entry/interface support pad.
Figure 3:
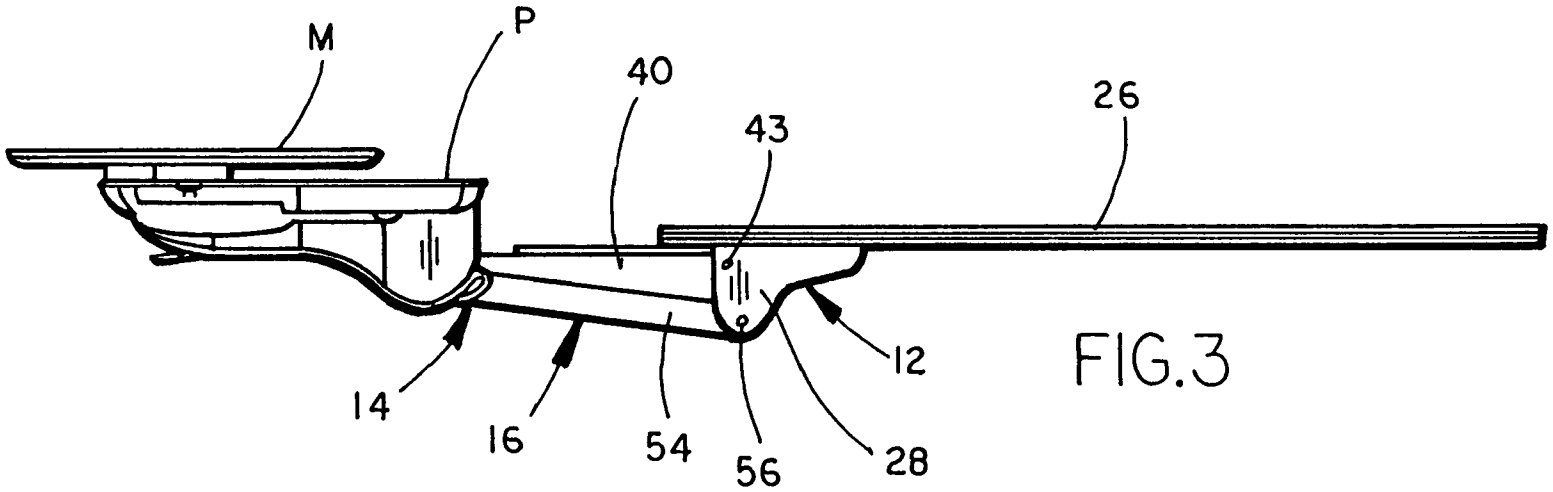
FIG. 3 is another side elevation of the adjustable support assembly of the present invention including decorative housings surrounding the support assembly on the under side of the data entry/interface device support pad.
Figure 4:
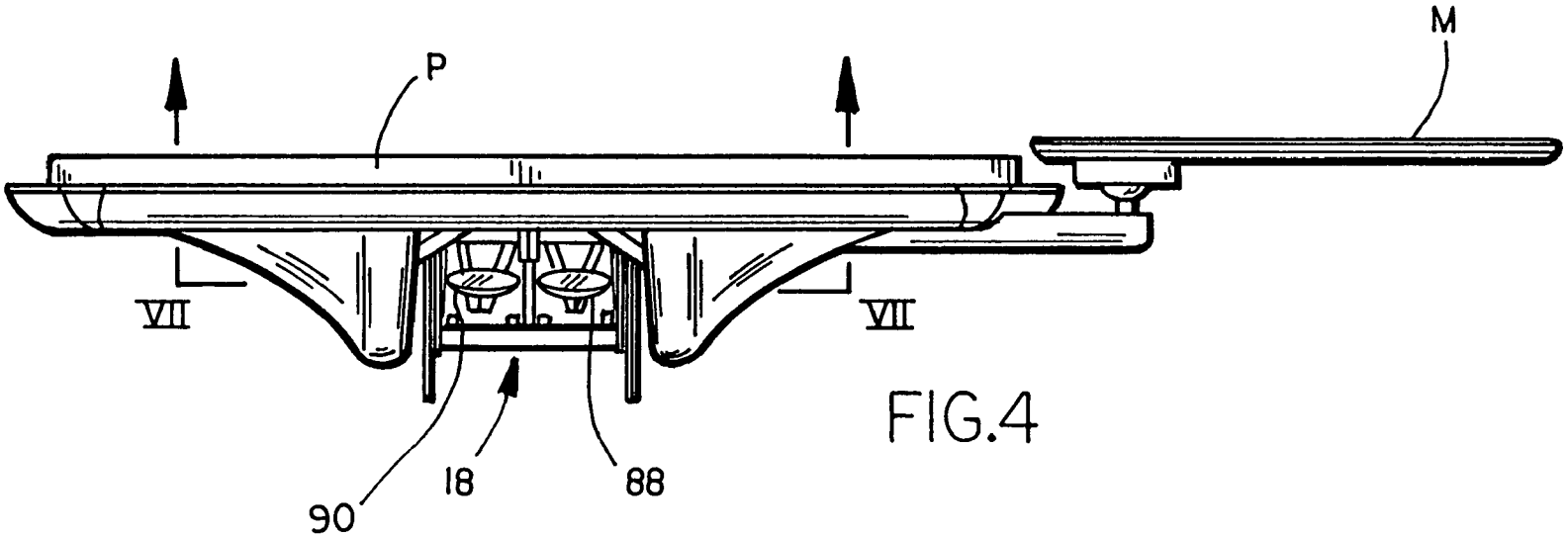
FIG. 4 is a front elevation of the adjustable support assembly shown in FIG. 3.
Figure 5:
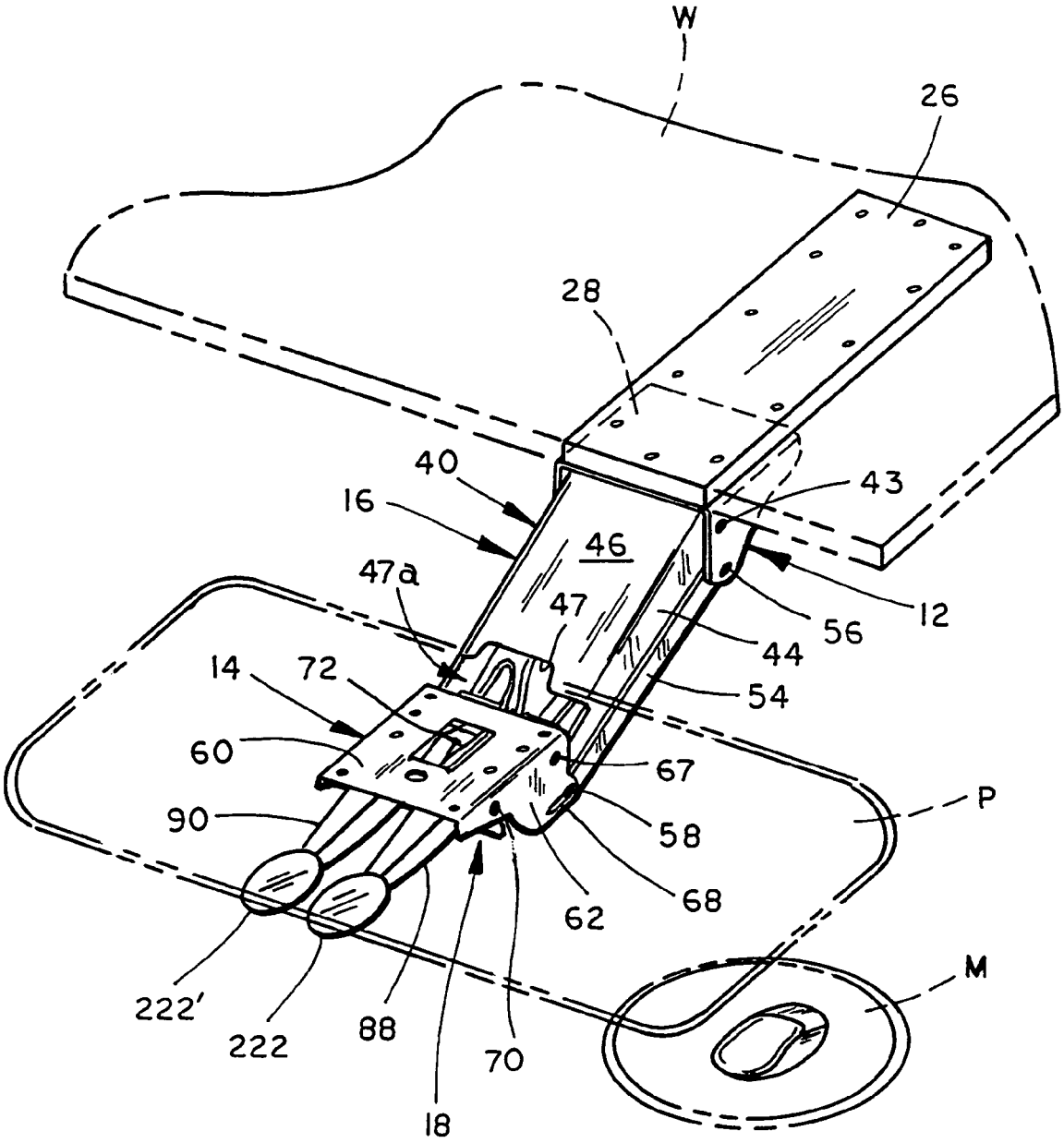
FIG. 5 is a perspective view of the adjustable support assembly when mounted to the underside of a work surface, wherein the data entry/interface support pad, mouse pad and work surface are shown in phantom.

As is best seen in FIGS. 3 and 5–8, swivel assembly 12 includes a swivel plate 20 having parallel, opposed, offset edges or flanges 22 each of which includes a pair of spaced plastic slide guides or spacers 24 fitted over the edges of the flanges 22 such that they extend on top and bottom surfaces thereof. Guides 24 are received in the inwardly opening channels of elongated work surface support plate 26 adapted to be fastened by screws or the like to the underside of work surface W as shown in FIG. 5. When swivel plate 20 is received beneath work surface support plate 26, with flanges 22 and guides 24 received in the channel portions of the bracket 26, plate 20 can be slid forwardly and rearwardly along and under the work surface such that the entire adjustable support assembly can be slid rearwardly to a storage position beneath the work surface or moved forwardly for access to the keyboard or other data entry/interface device as shown in FIGS. 2, 3 and 5.

Pivotally mounted beneath swivel plate 20 is a swivel bracket 28 having a pair of spaced, downwardly extending side flanges or side walls 30 having aligned pairs of circular apertures 32, 34 for receiving carriage bolts for pivotal support of linkage assembly 16 as will be described more fully below. Swivel bracket 28 is pivotally secured to swivel plate 20 for rotational movement by means of a swivel bolt 36 extending through aligned apertures in swivel plate 20 and swivel bracket 28 with a friction reducing nylon or other plastic disc 38 and suitable metallic or other washers interposed therebetween.

With reference to FIGS. 2, 3 and 5–8, linkage assembly 16 is generally of the type described in commonly-assigned U.S. Pat. No. 6,409,127 to VanderHeide et al., the disclosure of which is hereby incorporated by reference herein. Linkage assembly 16 includes linkage mount or support arm 40 which is pivotally coupled by means of aligned apertures 42 in downwardly extending side walls 44 of the linkage mount (FIGS. 8 and 8A) between downwardly extending side walls 30 of swivel bracket 28 by means of a headed rod 43 extended through apertures 42, 32. Side walls 44 of linkage mount 40 are connected by a planar top plate 46 extending therebetween. Side walls 44 extend forwardly to aligned, triangularly shaped, mounting flanges 48 (FIGS. 8A and 8B) which are spaced outwardly beyond the front edge 47 of top plate 46 to provide a space 47*a* (FIGS. 5–7) therebetween in which adjustment clamp housings 80, 82 are fitted as will be explained more fully below. Mounting flanges 48 extend between the downwardly extending side walls 62 of data entry/interface mount 14 and include aligned apertures 50 which are aligned with apertures 66 in side walls 62 and receive stepped rivets 67 or other fasteners (FIG. 8B) to pivotally join data entry/interface mount 14 to linkage mount 40 (FIGS. 2 and 5) as will be more fully explained below. In addition, as shown in FIGS. 8A and 8B, mounting flanges 48 include arcuate slots or apertures 52. The center of the arc of slots 52 is spaced along a radius from aperture 50. Adjacent either downwardly extending side flange 44 of linkage mount 40 is a link bar 54 having an aperture at each end. A rearward aperture 55 of each link bar 54 is pivotally secured by means of headed rod 56 to one of the aligned apertures 34 in the downwardly extending side walls 30 of swivel bracket 28 as shown in FIGS. 2 and 5. The forward aperture 57 of each link bar 54 is pivotally secured to headed rod 58 as explained below.

Figure 6:
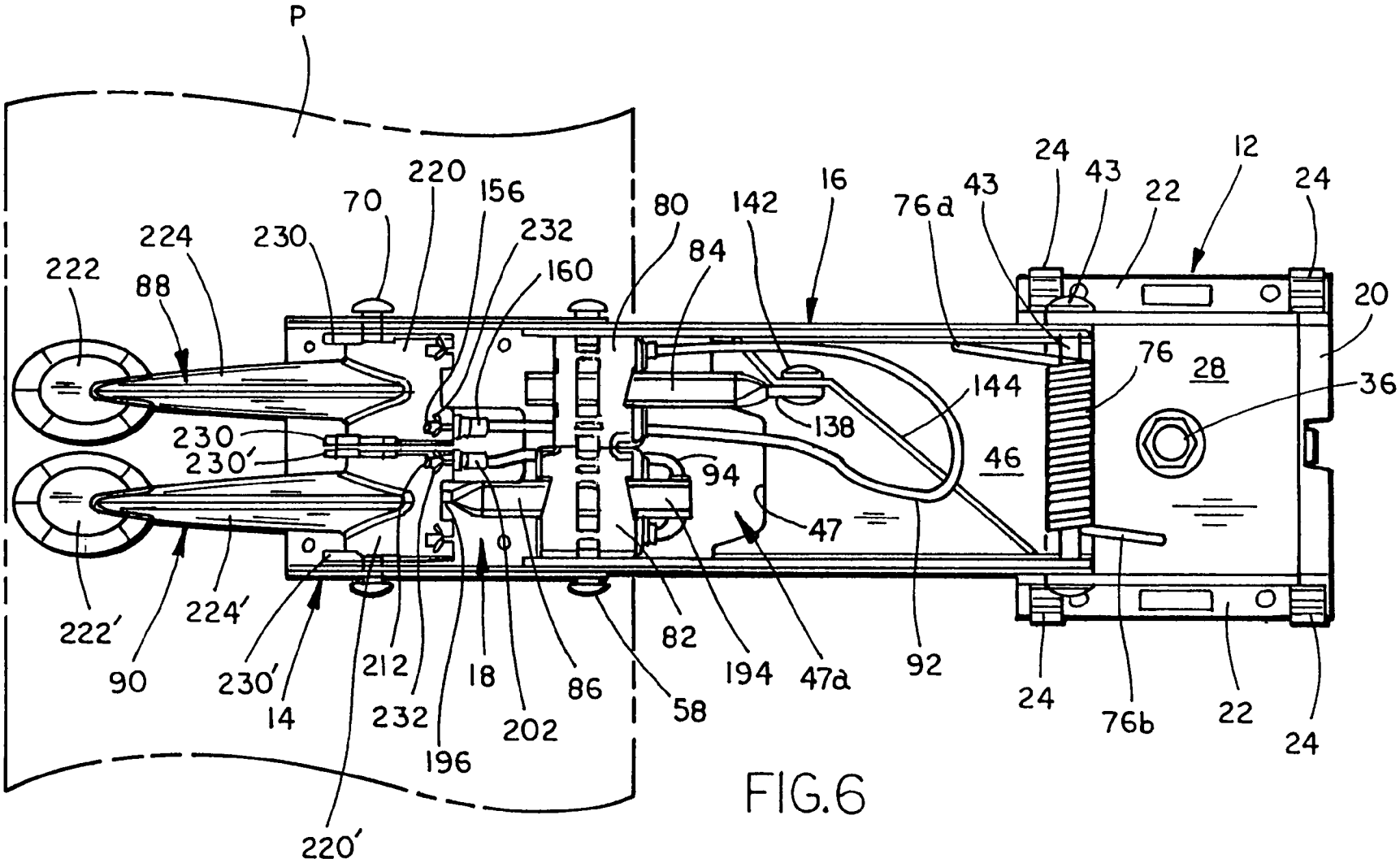
FIG. 6 is a bottom plan view of the adjustable support assembly of the present invention shown in FIG. 5.
Figure 7:
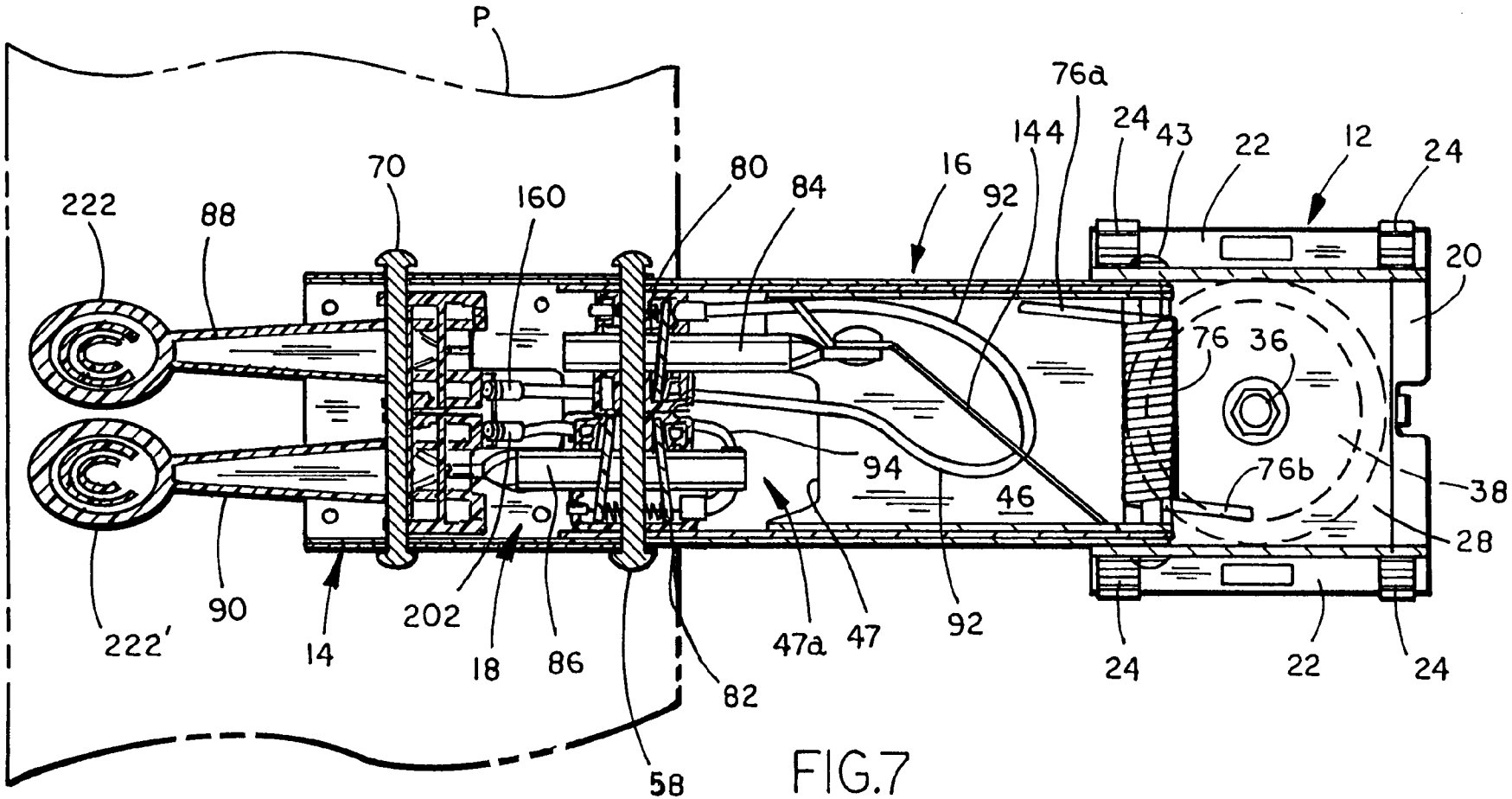
FIG. 7 is a sectional bottom plan view of the adjustable support assembly similar to FIG. 6 but taken along plane VII—VII of FIG. 4.
Figures 8, 8A:
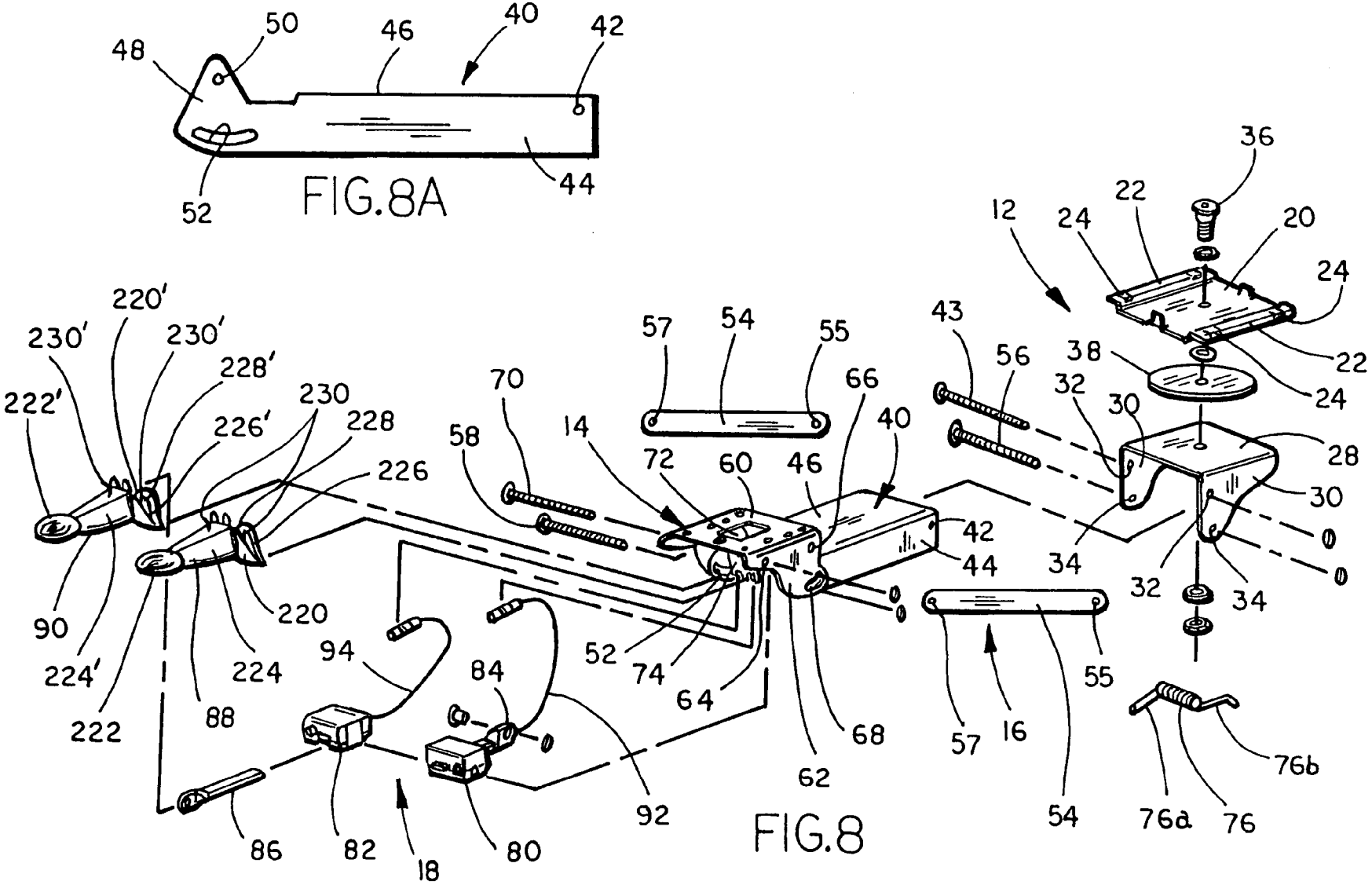
FIG. 8 is an exploded perspective view of the adjustable support assembly of the present invention.
FIG. 8A is a side elevation of the linkage mount of the linkage assembly of the present invention.
Figure 8B:
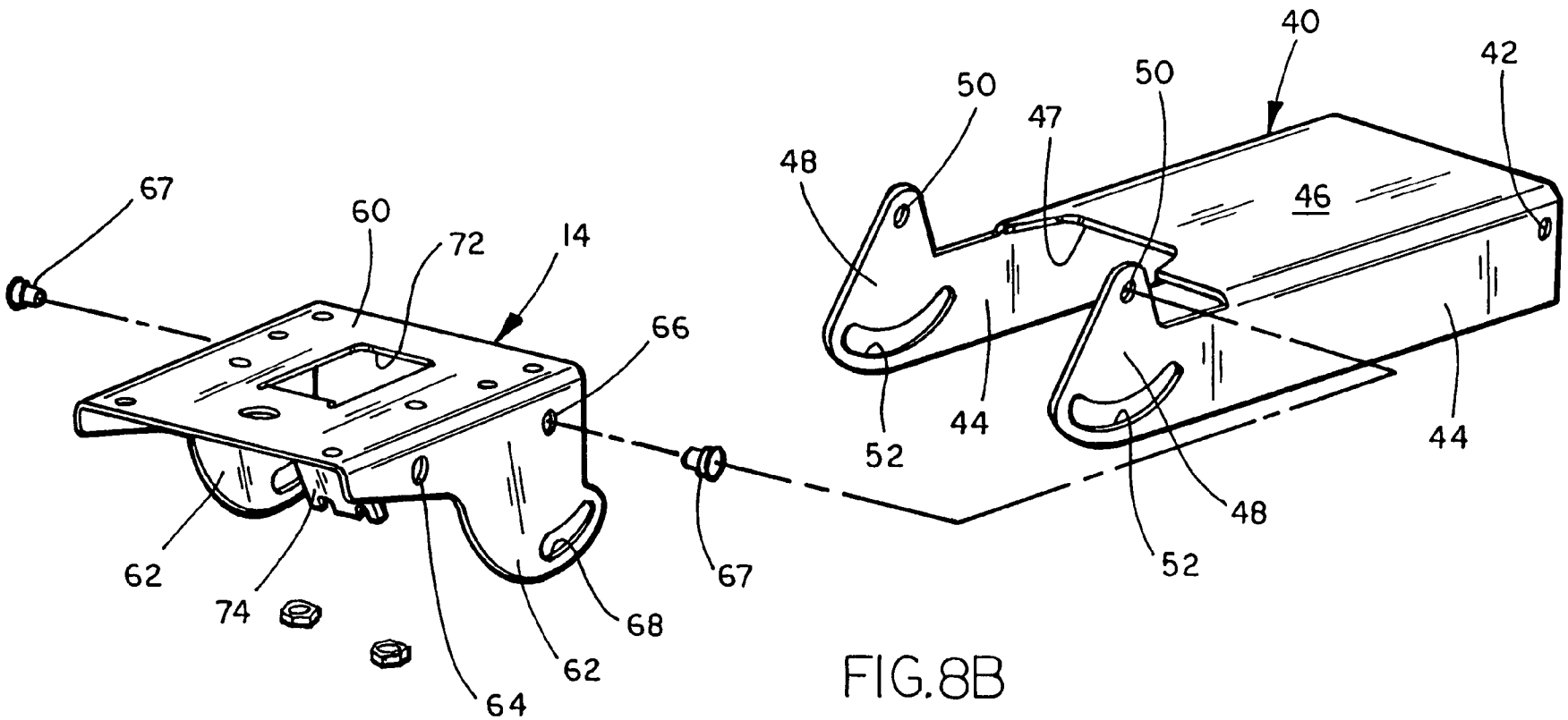
FIG. 8B is an exploded perspective view of the linkage mount and data entry/interface mount of the present invention.

As is best seen in FIGS. 2, 5–8, and 8B, data entry/interface mount 14 includes a generally planar central plate 60 and a pair of spaced side walls 62 extending downwardly from each lateral edge of central plate 60. Side walls 62 include a pair of aligned apertures 64 toward the front of the side walls and aligned apertures 66 toward the rear of the side walls. In addition, each side wall includes an arcuate slot 68 formed on a radius from aperture 66 in the lower portion of the side wall. In addition to apertures 64, 66 and 68, data entry/interface mount 14 also includes a central rectangular aperture 72 (FIGS. 5 and 8B) from which a downwardly extending mounting flange 74 is bent to receive and affix the ends of actuation cables 92, 94 as set forth below. In addition, linkage mount 40 and data entry/interface mount 14 can both move up and down with respect to swivel bracket 28 about headed rod 43 forming a pivot between linkage mount 40 and swivel bracket 28. In addition, a torsion coil spring 76 is mounted on headed rod 43 (FIGS. 6–8). Coil spring 76 includes one rectilinear arm 76*a* engaging the underside of plate 46 of linkage mount 40 and the other arm 76*b* including a hook (FIG. 8) and engaging headed rod 56 on which link bars 54 are pivotally mounted. Thus, coil spring 76 urges linkage mount 40, and thus linkage assembly 16 and data entry/interface mount 14 which is pivotally mounted thereon, upwardly to counterbalance the weight of any keyboard pad, keyboard or other data entry/interface device and mouse support pad while downward pivoting is resisted by the adjustment clamp assembly 80 as described below.

As mentioned above, data entry/interface mount 14 is pivotally secured to linkage mount 40 by means of stepped rivets or other fasteners 67 extending through aligned apertures 66 and aligned apertures 50 in mounting flanges 48 of linkage mount 40. This allows the data entry/interface mount 14 to pivot with respect to linkage mount 40 about a horizontal axis defined by rivets 67. In addition, headed rod 58 extends through aligned arcuate slots 68 in data entry/interface mount side walls 62, through arcuate slots 52 in linkage mount 40, and through apertures 57 in the forward ends of link bars 54. This coupling arrangement allows linkage mount 40 to rotate about a horizontal axis on headed rod 43 which runs transverse to the linkage mount, while data entry/interface mount 14 pivots about a parallel horizontal axis on rivets 67. During such movement, headed rod 58 slides in arcuate slots 52 and 68 of data entry/interface mount 14 and linkage mount 40 while carrying the end of link bar 54. The mounting of link bars 54 to arcuate slots 52 via headed rod 58 enables the vertical pivotal movement of linkage mount 40 to occur without restriction from the ends of rigid link bars 54 since headed rod 58 moves forwardly or rearwardly in slots 52 as the linkage assembly is pivoted up or down respectively. Linkage assembly 16 is pivoted upwardly and downwardly to raise and lower the height of the data entry/interface mount 14 without changing the angular tilt or orientation of data entry/interface mount 14 as explained below.

As described below, headed rod 58 also provides a pivotal mounting for adjustment clamp assemblies 80, 82 which are controlled by handles 88, 90 to allow both angular tilt adjustment of data entry/interface mount 14 with respect to linkage mount 40 and height adjustment of data entry/interface mount 14 and linkage 16 with respect to swivel bracket 28. When the tilt position of data entry/interface mount 14 is fixed by clamp assembly 82 as described below, and clamp assembly 80 is released, the entire linkage assembly 16 and data entry/interface mount 14 is free to move up or down for height adjustment because headed rod 58 slides forwardly or rearwardly as necessary in slot 52 of linkage mount 40 without changing the angular orientation or tilt of data entry/interface mount 14. Conversely, when the positions of data entry/interface mount 14 and linkage mount 40 are fixed by clamp assembly 80 to restrict downward height adjustment, the tilt of data entry/interface mount 14 may be adjusted with respect to linkage assembly 16 and work surface W when clamp assembly 82 is released because headed rod 58 slides within slot 68 as data entry/interface mount 14 pivots on rivets 67. Thus, the height and tilt adjustments can be made independently of one another, although release of both clamp assemblies 80, 82 simultaneously allows both adjustments to be made at the same time.

With reference to FIGS. 6–13, adjustment assembly 18 controls the angular tilt of data entry/interface mount 14 with respect to linkage mount 40 as well as the height of linkage assembly 16 and data entry/interface mount 14 with respect to the work surface mount, namely, swivel bracket 28, and work surface W. Adjustment assembly 18 includes a pair of molded plastic, adjustment release assemblies or clamp housings 80, 82 pivotally mounted on headed rod 58 beneath data entry/interface mount 14 (FIGS. 6–11), a pair of rigid adjustment members or bars 84, 86 engaging the respective clamp housing 80, 82, and respectively connected between rod 58 and linkage assembly 16 or data entry/interface mount 14, and a pair of elongated actuator handles 88, 90 each pivotally mounted in side-by-side fashion beneath data entry/interface mount 14 on headed rod 70 and extending forwardly from the data entry/interface mount to a position adapted to be adjacent the forward edge of pad P as shown in FIGS. 5–7. Actuator handle 88 is connected to clamp assembly 80 via an elongated, flexible, cable actuator 92 while a second elongated, flexible, cable actuator 94 is connected between actuator handle 90 and clamp housing 82, as shown in FIGS. 6 and 7. Handles 88, 90 are secured in side-by-side fashion for separate pivotal actuation around headed rod 70 on the underside of data entry/interface mount 14 and any supported pad P thereon such that one or both of the handles may be grasped by a data entry/interface user with one hand and alternately activated either on an individual basis, or simultaneously if both handles are depressed at the same time.

Figure 9:
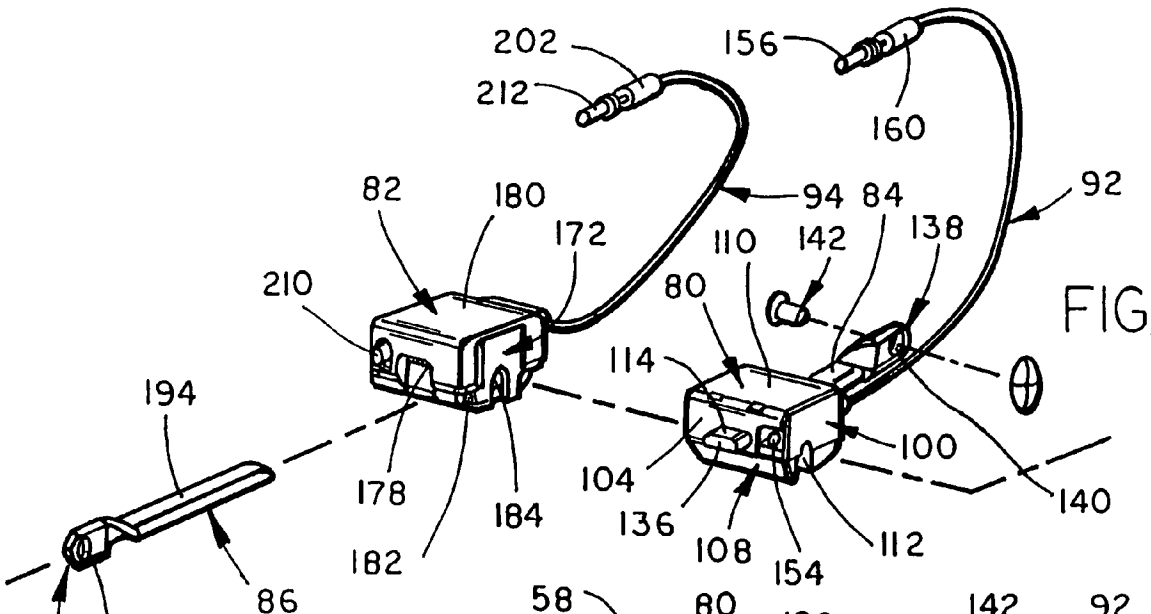
FIG. 9 is a perspective view of the cable actuated, adjustment clamp assemblies which allow adjustment of both tilt and height in the present invention.
Figure 10:
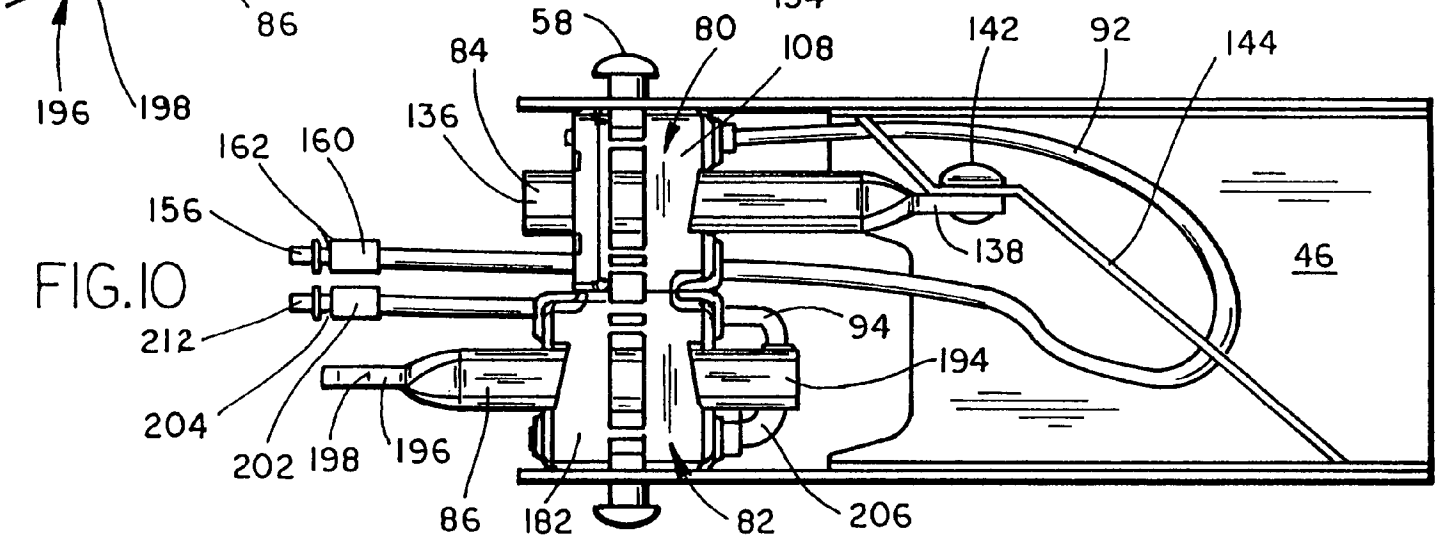
FIG. 10 is an enlarged bottom plan view of a portion of the adjustable support assembly showing the adjustment assemblies pivotally mounted in side-by-side fashion on a portion of the linkage assembly.
Figure 9B:
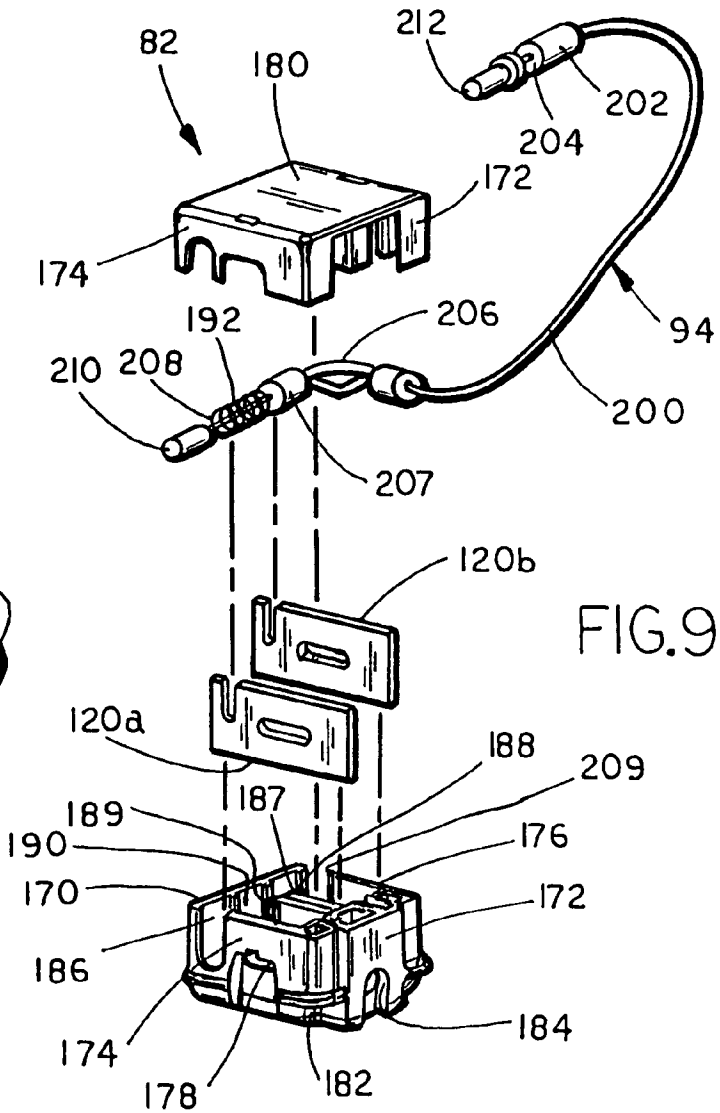
FIG. 9B is an exploded perspective view of the preferred tilt adjustment clamp assembly and its cable actuator.
Figure 9A:
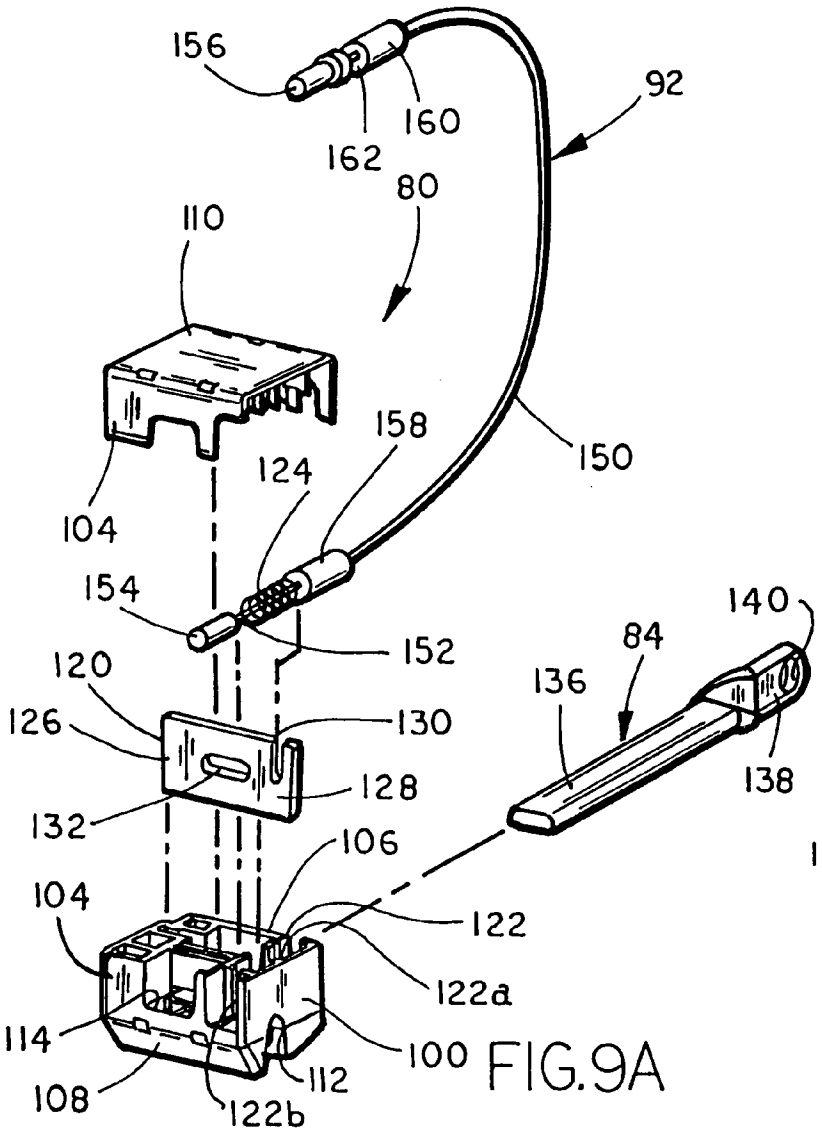
FIG. 9A is an exploded perspective view of the preferred height adjustment clamp assembly and its cable actuator.
Figure 11:
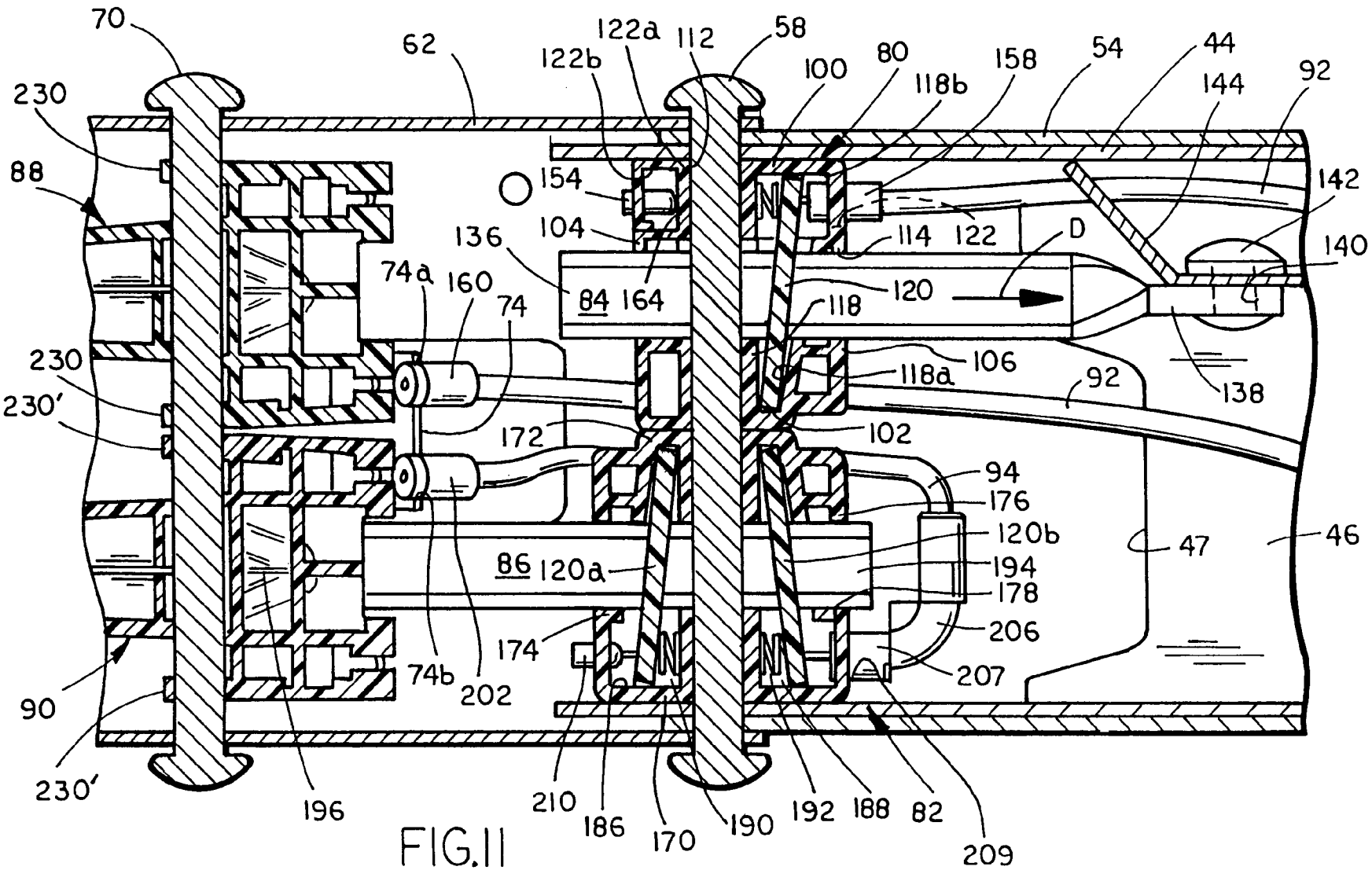
FIG. 11 is an enlarged, sectional, bottom plan view of the adjustment clamp assemblies and portions of the actuator handles and cable actuators connected therebetween.
Figures 12, 13, 14:
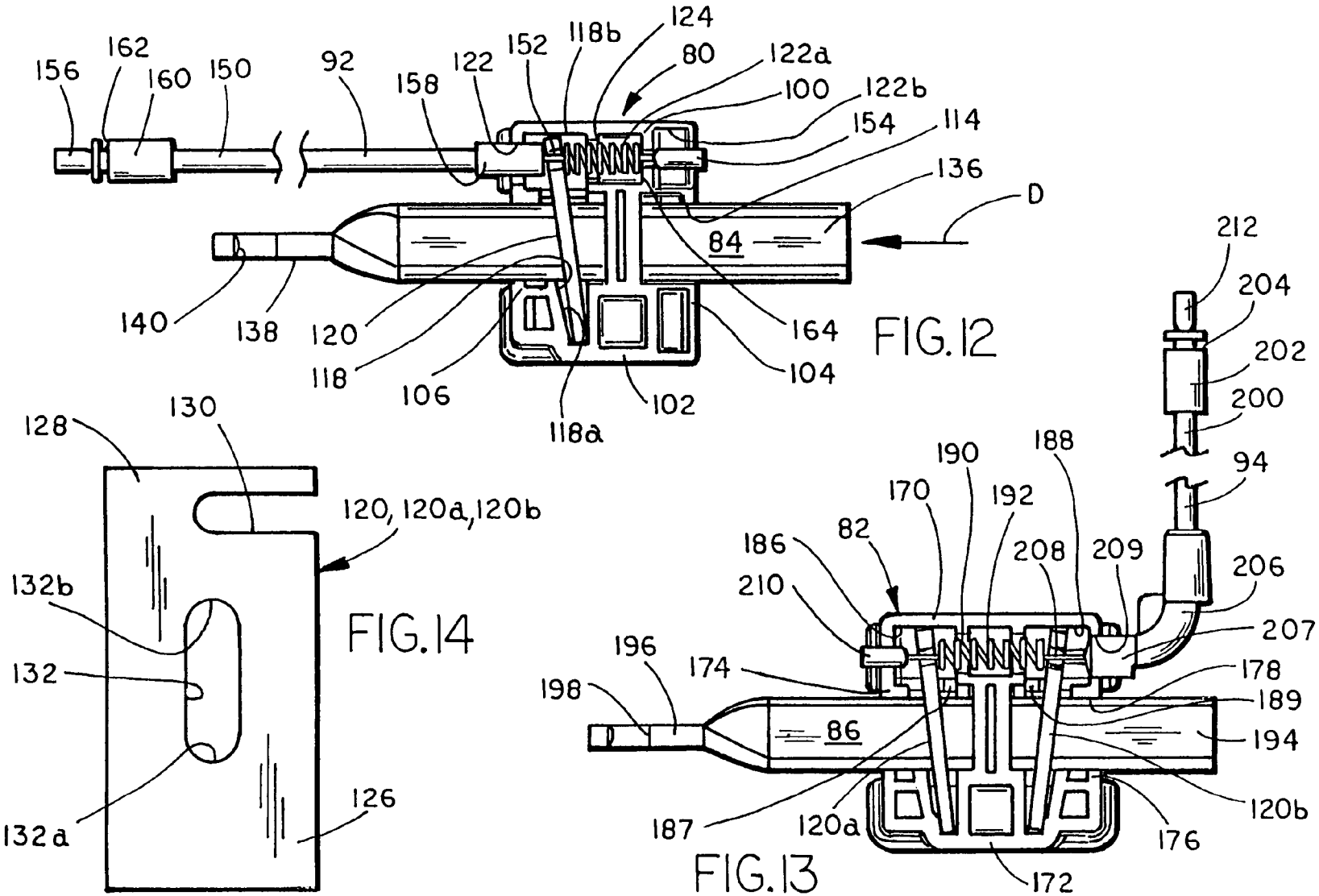
FIG. 12 is a plan view of the cable actuated height adjustment clamp assembly and adjustment bar extending therethrough with portions of the clamp housing removed.
FIG. 13 is a plan view of the cable actuated angular tilt adjustment clamp assembly and adjustment bar extending therethrough with portions of the clamp housing removed.
FIG. 14 is an elevation of one of the clamp bars of the present invention.

As is best seen in FIGS. 9, 9A, 9B and 10–13, adjustment clamp assemblies or housings 80, 82 are preferably molded from a strong, resilient plastic material such as nylon to provide a rectangular enclosure through which the headed rod 58 is received in a direction transverse to rigid adjustment members or bars 84, 86 and cable actuators 92, 94. Clamp housing 80 includes opposed side walls 100, 102 which extend generally parallel to side walls 44 of linkage mount 40, link bar 54 and side walls 62 of data entry/interface mount 14 when mounted on headed rod 58. Side walls 100, 102 extend generally perpendicular to housing front and rear walls 104, 106, while bottom wall 108 and top wall 110 complete the enclosure (FIGS. 6, 9 and 10). Preferably, top wall 110 forms a portion of a top housing member which is removably held on the remainder of housing 80 by suitable molded clips or snaps (FIG. 9A) and is assembled after the remaining clamp components are inserted in the housing as explained below. Side walls 100, 102 define a circular aperture 112 extending therethrough for receipt of headed rod 58, while front wall 104 and rear wall 108 define a generally rectangular aperture 114 having rounded ends corresponding to the cross-sectional shape of adjustment bar 84. Aperture 114 extends entirely through the housing 80 on a plane offset from aperture 112. Housing 80 also includes a laterally extending internal chamber 118 having a generally V-shaped configuration in section for receiving rectilinear clamp member or bar 120 as shown in FIGS. 11–13. Chamber 118 includes V-shaped end 118*a* having width slightly larger than the thickness of clamp bar 120 and an opposite end 118*b* having a width significantly larger than the thickness of clamp bar 120 to provide room for pivoting the bar as explained more fully below. Additionally, housing 80 includes aperture 122 receiving one end 158 of cable actuator 92. Aperture 122 extends through housing 80 generally parallel to side wall 100 and further includes an enlarged chamber 122*a* receiving a coil spring 124 therewithin for biasing clamp bar 120 into clamping position, and chamber 122*b* which opens to the exterior of the housing for receiving the enlarged end 154 of the moveable wire cable 152 within cable actuator 92. Preferably, spring 124 has a compression strength of 12.6 pounds per inch.

As is best seen in FIGS. 9, 9A, 9B and 14, clamping member 120 is an elongated, rectangular, rigid bar preferably formed from hardened steel or other metal including one end 126 adapted to be received in housing chamber 118*a* and an opposite end 128 adapted to be received in housing chamber 118*b*. End 128 includes a slot 130 which opens toward cable actuator 92 such that the cable may be inserted therein when assembled to housing 80. In addition, bar 120 includes a generally rectangular clamping aperture 132 having radiused ends 132*a*, 132*b* and a length slightly longer than the width of adjustment bar 84 to allow pivotal movement of the clamping bar with respect to the adjustment bar when actuated by cable actuator 92. Aperture 132 has the shape of the cross-section of adjustment bar 84 but is somewhat larger.

As shown in FIGS. 9–12, adjustment member 84 is an elongated, rigid bar preferably formed from hardened steel, rigid plastic or the like having a width greater than its thickness. One end 136 is rectilinear and adapted to be received through aperture 114 in housing 80. The opposite end 138 is twisted 90° with respect to the width of bar end 136 and, thus, extends in a plane perpendicular to the plane including the width of bar end 136. End 138 includes through aperture 140 which is pivotally secured by a fastener such as rivet 142 to a section of a strengthening web or gusset 144 which is welded to the under side of linkage mount 40 as shown in FIGS. 6, 7, 10 and 11. Bar 84 may, thus, pivot about rivet 142 while end 136 of bar 84 reciprocates through aperture 114 as the height of the linkage assembly 16 and data entry/interface mount 14 is changed up or down with respect to swivel assembly 12 and work piece W.

As is best seen in FIGS. 9–12, cable actuator 92 is a coaxial, flexible actuating cable such as a Bowden wire cable, having an outer sheath 150 of plastic or rubber and an inner wire 152 of steel or other metal which is reciprocable through the outer sheath. Inner wire 152 includes enlarged, fixed ends 154, 156. Outer sheath 150 includes an enlarged cylindrical end portion 158 secured thereto and an enlarged, cylindrical end fixture 160 including securing groove 162 therein at the opposite end of the cable. End fixture 160 is also preferably fixed to the outer sheath. To assemble housing 80 with cable actuator 92 and adjustment bar 84 when top wall 110 is removed, clamp bar 120 is first placed in the opened housing 80 with aperture 132 aligned with through aperture 114. Next, cable actuator end 154 is inserted in chamber 122*b* while wire 152 is inserted in slot 130 of clamp bar 120 and spring 124 is placed in chamber 122*a*. Enlarged end 154 abuts against wall 164 while wire 152 extends through a small aperture therein. Coil spring 124 is then aligned with and inserted in chamber 122*a* such that one end of the coil spring abuts against wall 164 while the opposite end abuts against the inner side of clamp bar 120. Cylindrical end 158 of outer sheath 150 passes through aperture 122 in rear wall 106 of housing 80. Sheath end 160 of the cable actuator is then threaded through apertures in gusset 144, looped back toward handle 88, and secured to recess 74*a* of flange 74 of data entry/interface mount 14 via fastening recess 162 with a press fit (FIG. 11). Inner cable end 156 is then secured to recess 232 at the inner end of handle 88 (FIG. 6). When assembled in this manner and actuated by pivotal movement of handle 88, outer sheath end 160 is stationary in flange 74 while enlarged end 154 of inner wire 152 is fixed against wall 164 of housing 80. Movement of the handle thereby draws outer sheath end 158 inwardly within housing 80 against the outer side of clamp bar 120 opposite spring 124 thereby pivoting the clamp bar from the clamping position shown in FIG. 12 to a release position in which coil spring 124 is compressed and clamp bar 120 extends substantially transverse and perpendicular to the axis of adjustment bar 84. In the release position, aperture 132, which is larger than the cross sectional shape of adjustment bar 84, thereby allows sliding movement of the bar with respect to housing 80. However, when handle 88 is released thereby allowing sheath end 158 to move outwardly, spring 124 urges and pivots clamp bar 120 to its clamped position shown in FIGS. 11 and 12. In that position, the corners at the inner and outer surfaces of clamp bar 120 at aperture ends 132*a*, 132*b* of aperture 132 bite into the edges of bar 84 and prevent reciprocal movement of the bar through housing 80 in the direction of arrow D in FIGS. 11 and 12. Such clamping prevents linkage assembly 16 and data entry/interface mount 14 from pivoting downwardly with respect to swivel assembly 12 thereby resisting any pressure applied by the user during use of the keyboard or other data entry/interface device. However, movement in the opposite direction to raise the linkage assembly and data entry/interface mount with the help of counterbalancing force of spring 76 can take place without release of clamp bar 120 with a slight upward force from the keyboard operator since movement in a direction opposite arrow D is not restrained by the biting action of the corners of aperture 132 on bar 84. Such movement also urges clamp bar 120 toward its release position as bar 84 moves oppositely to arrow D.

Adjustment clamp housing 82 is similar to clamp housing 80 except that a pair of clamping bars 120*a*, 120*b* are included in housing 82 such that adjustment bar 86 is prevented from reciprocating in either direction when those clamp bars are in their clamped positions. More specifically, as is best shown in FIGS. 11 and 13, clamp housing 82 includes side walls 170 and 172 extending parallel to side walls 44 and 62 and link bar 54 when mounted on headed rod 58, as well as front wall 174 and rear wall 176 having aperture 178 extending therethrough in a manner similar to aperture 114 in housing 80. Housing 82 includes a removable top having top wall 180 similar to top wall 110 on housing 80 (FIG. 9) and a bottom wall 182 completing its enclosure. A circular aperture 184 extends transversely through housing 82 on a plane offset from the plane of aperture 178 and receives rod 58 therethrough. Housing 82 also includes a pair of V-shaped, internal chambers 186, 188 each receiving one of the hardened steel clamp bars 120*a*, 120*b*, respectively, in the same manner in which clamp bar 120 is received in housing 80. Clamping bars 120*a*, 120*b* are substantially similar to bar 120 as shown in FIG. 14. Stops or stop members 187, 189 (FIG. 13) are formed on the center wall of housing 82 to contact clamp bars 120*a*, 120*b* when pivoted toward their release positions. Stops 187, 189 limit pivotal movement of each clamp bar to prevent one clamp bar from being fully pivoted upon actuation without movement of the remaining clamp bar away from its clamping position when one clamp bar is under load and the other is not. In addition, a coil spring 192 is received in chamber 190 extending generally parallel to side wall 170 such that the ends of the spring engage the inner side of clamp bars 120*a*, 120*b* while actuator wire 208 from cable actuator 94 is telescoped therethrough and through slots 130 of the clamp bars. Preferably, spring 192 has a compression strength of 8.7 pounds per inch.

Adjustment bar 86 is similar to adjustment bar 84, is preferably formed from hardened steel, and includes a rectilinear end 194 extended through aperture 178 of housing 82, and apertures 132 of clamp bars 120*a*, 120*b*, and a fastening end 196 extending in a plane rotated 90° from that of end 194 and having a through aperture 198 therein for attachment to headed rod 70 when housing 82 is mounted on data entry/interface mount 14 via carriage bolt 58.

In a manner similar to cable actuator 92, cable actuator 94 is a flexible, actuating cable such as a Bowden wire cable including an outer sheath 200, an enlarged cylindrical fitting 202 attached to the outer sheath and including a fastening groove 204 therein received in recess 74*b* of flange 74 of data entry/interface mount 14, as well as a molded plastic right angle fitting or elbow 206 through which inner wire 208 extends. Elbow 206 enables the cable actuator to be bent through a small radius turn within the support assembly such that cable actuator 94 can be turned 180° from its attachment point on housing 82 for attachment to handle 90 as explained below. Elbow 206 includes a cylindrical end 207 slidably mounted in aperture 209 of the housing. In housing 82, inner wire 208 includes enlarged end 210 slidably mounted in housing wall 174, and enlarged end 212 mounted in recess 232 of handle 90. Activation of handle 90 draws inner wire 208 toward the handle such that enlarged end 210 urges clamp bar 120*a* toward its release position while clamp bar 120*b* is correspondingly moved inwardly by end 207 of fitting 206, both movements occurring against the force of spring 192. Accordingly, when handle 90 is actuated, and clamp bars 120*a*, 120*b* are moved to their release positions, adjustment bar 86 can reciprocate in either direction thus allowing the angular orientation or tilt of data entry/interface mount 14 to be changed by rotation in either direction around pivot 66 guided and limited by slot 68. Conversely, when handle 90 is released, coil spring 192 urges clamp bars 120*a*, 120*b* to their clamped positions as shown in FIGS. 11 and 13 such that the corners 132*a*, 132*b* of each aperture 132 bite into the edges of bar 86 preventing its sliding, reciprocal movement and fixing the angular orientation or tilt of data entry/interface mount 14 as desired. Thus, further rotation or tilt in either direction is prevented until handle 90 is again actuated to release clamp bars 120*a*, 120*b*.

As will be understood, in an alternate embodiment, a clamp housing similar in all respects to housing 82 including a pair of clamp bars 120*a*, 120*b*, and a cable actuator similar to cable actuator 94 can be substituted for clamp housing 80 if desired. With such a change, and the substituted cable actuator connected to actuator handle 88, clamping of adjustment bar 84 with two clamp bars can be obtained such that bar 84 would be clamped and restrained from sliding movement in either direction. Such clamping would prevent adjustment of the height of data entry/interface mount 14 on linkage assembly 16 either up or down without depressing handle 88 and releasing the clamp bars.

As shown in FIGS. 2, 4–8 and 11, actuator handles 88, 90 are identical and are preferably molded from resinous plastic material such as ABS or nylon. Each molded handle 88, 90 includes a mounting base 220, 220', an engagement pad 222, 222' adapted to engage the hand or fingers of a keyboard user, and an intermediate connecting section 224, 224' extending between mounting base 220, 220' and engagement pad 222, 222'. Each mounting base 220, 200' has a curved surface adapted to match the contour of the under surface of the support assembly and a pair of side walls 226, 226' at the edges of the mounting base through which a circular aperture 228, 288' (FIG. 8) extends generally transverse to the elongated direction of connecting section 224, 224'. Headed rod 70 extends through apertures 228, 228' to pivotally connect the handles to the side walls 62 under data entry/interface mount 14. In addition, at the upper edges of each mounting base 220, 220' are integrally molded extending spring members 230, 230', one spring member on each side of each handle 88, 90 as best seen in FIGS. 6 and 8. Spring members 230, 230' extend upwardly from the mounting base of each handle to engage the under side of data entry/interface mount 14 to provide a biasing force resisting pivotal movement of handles 88, 90 when actuated by a user. As such, and in conjunction with springs 124, 192, those spring members urge the pivotal handles back to their initial positions in which clamp bars 120, 120*a* and 120*b* are clamped against adjustment bars 84, 86 to prevent a downward change in the height of the support assembly or the angular orientation/tilt of the data entry/interface mount unless the handles are depressed and actuated.

Each handle 88, 90 has an overall length from engagement pad 222, 222' to pivot 70 calculated to provide a mechanical advantage of about 3.5 to 1 and a length ratio of 5.75 to 1.65 from the cable connection at recesses 232 to pivot when engagement pads 222, 222' are engaged by the hand or fingers of a keyboard user. As seen in FIG. 2, when handles 88, 90 are at rest, it is preferred that they extend downwardly at an angle $\alpha$ of about 10° to allow sufficient pivot space. When cable actuators 92, 94 are looped under housings 80, 82 and secured to flange 74 as mentioned above, such that cable ends 156, 212 are respectively engaged in grooves 232, 232' adjacent the inner edges of mounting bases 220, 220' as shown in FIG. 6, engagement of the keyboard user's hand or fingers with engagement pads 222, 222' as desired allows depression and actuation of handles 88, 90 in a direction toward support pad P in a pivotal action around headed rod 70. Such actuation pulls cable ends 156, 212 toward the front of data entry/interface mount 14 thereby moving wires 152, 208 and pivoting clamp bars 120, 120*a*, 120*b* from their clamping positions shown in FIGS. 11–13 to their release positions in which they extend generally transverse and perpendicular to adjustment bars 84, 86 thereby allowing reciprocation of bars 84, 86 through housings 80, 82 and adjustment of the height and angular tilt of the data entry/interface mount in the manner described above. Connecting sections 224, 224' of handles 88, 90 are molded to include a hollow V-shaped configuration in section for strength and rigidity to counteract the forces of spring members 124, 192, 230 and 230' when handles 88, 90 are engaged and depressed.

Accordingly, as will now be understood, the adjustable support assembly of the present invention may be pivotally adjusted from side-to-side in the direction of arrow C in FIG. 1 about swivel assembly 12. In addition, the height of the support pad P and any auxiliary mouse pad M may be adjusted with respect to the position of work surface W on linkage assembly 16 and data entry/interface mount 14 by engaging and depressing paddle 222 of handle 88 thereby pivoting the handle on headed rod 70 to release clamp bar 120 in housing 80 allowing the assembly to be moved downwardly while the angular orientation or tilt of the data entry/interface mount remains unchanged. The weight of the keyboard or other data entry/interface device and support pad P as well as linkage assembly 16 and data entry/interface mount 14 substantially counterbalance the strength of coil spring 76 on headed rod 43 such that the assembly does not move upwardly. However, if urged upwardly by the keyboard user, coil spring 76 compliments such upward force provided by the user so that upward adjustment is facilitated. Preferably, the strength of torsional coil spring 76 is 0.2 inch pounds per degree. In the event a longer linkage assembly 16 is included in assembly 10, the preload angles of spring arms 76*a*, 76*b* are chosen to provide a greater preload force to counterbalance the greater moment arm of the longer assembly.

Alternately, and independently, engagement pad 222' of handle 90 may be engaged and depressed separately by the keyboard user thereby moving clamp bars 120*a*, 120*b* to their release positions and allowing the angular orientation or tilt of data entry/interface mount 14 on fasteners 67 to be changed either upwardly or downwardly. When handle 90 is released, the force of coil spring 192 and integral handle springs 230' returns clamp bars 120*a*, 120*b* to their clamped positions as shown in FIGS. 11 and 13 thereby locking adjustment bar 86 and preventing further tilt adjustment until handle 90 is again depressed.

As will be understood from FIGS. 1, 4, 5, 6, 7 and 11, the positioning of handles 88, 90 on headed rod 70 is side-by-side and in close proximity to one another such that both engagement pads 222, 222' can be grasped and depressed simultaneously with one hand by the user, if desired, or alternately, independently engaged and depressed as described above. When depressed simultaneously, both the height adjustment downwardly and angular orientation or tilt of the support pad P may be changed with respect to the work surface W while only one hand operation of both handles by the user is required. At all times during height adjustment of the data entry/interface mount 14, except when handle 90 is also depressed, the angular orientation of the data entry/interface mount remains unchanged as the height position on linkage assembly 16 changes due to the pivotal mounting arrangement described above.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow:

What is claimed is:

1. An adjustable support assembly for attachment to a work surface to support a data entry/interface device, said support assembly comprising:

a data entry/interface mount for engaging and supporting a data entry/interface device;

a work surface mount for attachment to a work surface;

a linkage assembly for adjustably connecting said data entry/interface mount to said work surface mount; and an adjustment assembly for adjusting the height and angular tilt positions of said data entry/interface mount on said linkage assembly with respect to said work surface mount, said adjustment assembly including a pair of actuator handles mounted on said data entry/interface mount, and a pair of release assemblies also mounted on said data entry/interface mount, one handle movable for operation of one of said release assemblies to adjust the height of said data entry/interface mount, the other handle movable for operation of the other release assembly to adjust the angular tilt of said data entry/interface mount, wherein each of said actuator handles is connected to its respective release assembly by a flexible, movable cable.

2. The support assembly of claim 1 wherein said actuator handles are mounted in close proximity to one another such that a user of said support assembly can engage and move one or both of said handles with one hand for adjustment of one or both of said height and said angular tilt of said data entry/interface mount as desired.

3. The support assembly of claim 1 wherein at least one of said release assemblies includes a movable clamp connected to its respective cable, whereby movement of its respective actuator handle causes movement of said clamp and release of the respective release assembly.

4. An adjustable support assembly for attachment to a work surface to support a data entry/interface device; said support assembly comprising:

a data entry/interface mount for engaging and supporting a data entry/interface device;

a work surface mount for attachment to a work surface;

a linkage assembly for adjustably connecting said data entry/interface mount to said work surface mount;

a first adjustment assembly having engaged and release positions such that the height of said data entry/interface mount on said linkage assembly may be adjusted with respect to said work surface mount when in said release position;

a first handle movably mounted on said data entry/interface mount for access and movement by a user of the data entry/interface device when the data entry/interface device is mounted on said data entry/interface mount;

a first cable actuator coupled between said first handle and said first adjustment assembly, said first cable actuator actuating said first adjustment assembly from said engaged to said release position and allowing adjustment of said height of said data entry/interface mount when said first handle is moved by the data entry/interface user;

a second adjustment assembly having engaged and release positions such that the angular tilt of said data entry/interface mount on said linkage assembly may be adjusted with respect to said work surface mount when in said release position;

a second handle movably mounted on said data entry/interface mount separate and independent of said first handle for access and movement by the data entry/interface user when the data entry/interface device is mounted on said data entry/interface mount;

a second cable actuator coupled between said second handle and said second adjustment assembly, said second cable actuator actuating said second adjustment assembly from said engaged to said release position and allowing adjustment of said angular tilt of said data entry/interface mount when said second handle is moved by the data entry/interface user.

5. The support assembly of claim 4 wherein said first adjustment assembly includes a first adjustment member coupled to one portion of said linkage assembly, and a first clamp member mounted on at least one of said data entry/interface mount and said linkage assembly and engaging said first adjustment member, said first cable actuator being connected to said first clamp member for movement of said first clamp member between clamping and release positions upon movement of said first handle, said first clamp member resisting movement of said first adjustment member in at least one direction to resist a change in height of said data entry/interface mount when in said clamping position.

6. The support assembly of claim 5 wherein said second adjustment assembly includes a second adjustment member coupled to one portion of said data entry/interface mount, and at least one second clamp member movably mounted on at least one of said data entry/interface mount and said linkage assembly and engaging said second adjustment member, said second cable actuator being connected to said second clamp member for movement of said second clamp member between clamping and release positions upon movement of said second handle, said second clamp member resisting movement of said second adjustment member in at least one direction to resist a change in the angular tilt of said data entry/interface mount when in said clamping position.

7. The support assembly of claim 6 wherein said second adjustment assembly includes a pair of second clamp members, each of said second clamp members being movably mounted on a portion of said linkage assembly and engaging said second adjustment member, said second cable actuator being connected to both of said second clamp members such that said second clamp members are each movable between respective clamping and release positions simultaneously upon movement of said second handle, said pair of second clamp members resisting movement of said second adjustment member in two directions to resist changes in the angular tilt of said data entry/interface mount when in said respective clamping positions.

8. The support assembly of claim 7 wherein said first and second clamp members are mounted on the same portion of said linkage assembly.

9. The support assembly of claim 8 wherein said first and second clamp members are respectively mounted in first and second clamp housings, said first and second clamp housings being pivotally mounted on said same linkage assembly portion.

10. The support assembly of claim 9 wherein each of said first and second clamp housings includes a spring engaging the respective first and second clamp members, each spring urging its respective first clamp member or second clamp member to its respective clamping position.

11. The support assembly of claim 10 wherein said first and second handles each include a handle spring engaging said data entry/interface mount urging said handles toward their respective clamping positions.

12. The support assembly of claim 11 wherein each of said first and second handles is molded from a polymeric material, each of said first and second handles including said handle spring molded integrally therewith from said polymeric material.

13. The support assembly of claim 11 wherein said first and second handles are each pivotally mounted on said data entry/interface mount and are each elongated to increase the mechanical advantage to the user to release said respective first and second clamp members for adjustment of said data entry/interface mount.

14. The support assembly of claim 9 wherein each of said first and second clamp housings includes an aperture therethrough, said respective first and second adjustment members passing through and being confined by said aperture in said respective first and second clamp housings.

15. The support assembly of claim 7 wherein each of said first and second clamp members includes an aperture therethrough, said respective first and second adjustment members passing through said aperture in said respective first and second clamp members.

16. The support assembly of claim 15 wherein each of said first and second clamp housings includes an aperture therethrough, said respective first and second adjustment members passing through and being confined by said aperture in said respective first and second clamp housings.

17. The support assembly of claim 4 wherein said second adjustment assembly includes a second adjustment member coupled to one portion of said data entry/interface mount, and at least one second clamp member movably mounted on a portion of said linkage assembly and engaging said second adjustment member, said second cable actuator being connected to said second clamp member for movement of said second clamp member between clamping and release positions upon movement of said second handle, said second clamp member resisting movement of said second adjustment member in at least one direction to resist a change in the angular tilt of said data entry/interface mount when in said clamping position.

18. The support assembly of claim 17 wherein said second adjustment assembly includes a pair of second clamp members each movably mounted on a portion of said linkage assembly and engaging said second adjustment member, said second cable actuator being connected to both of said second clamp members such that said second clamp members are each movable between respective clamping and release positions simultaneously upon movement of said second handle, said pair of second clamp members resisting movement of said second adjustment member in two directions to resist changes in the angular tilt of said data entry/interface mount when in said respective clamping positions.

19. The support assembly of claim 4 wherein said first and second handles each include a handle spring engaging said data entry/interface mount urging said handles toward their respective clamping position.

20. The support assembly of claim 19 wherein said first and second handles are each pivotally mounted on said data entry/interface mount and are each elongated to increase the mechanical advantage to the user to release said respective first and second clamp members for adjustment of said data entry/interface mount.

21. The support assembly of claim 4 wherein said first and second handles are mounted in close proximity to one another such that a user of said support assembly can engage and move one or both of said handles with one hand for adjustment of one or both of said height and said angular tilt of said data entry/interface mount as desired.

22. An adjustable support assembly for supporting a data entry/interface device, said support assembly comprising:

a data entry/interface mount for engaging and supporting a data entry/interface device a work surface mount adapted to be coupled to a work surface;

a linkage assembly having one end coupled to said work surface mount and an opposite end coupled to said data entry/interface mount;

a first adjustment member having an axis of elongation and coupled to one of said data entry/interface mount and said linkage assembly, and adapted to move with said one of said data entry/interface mount and said linkage assembly upon movement thereof;

a first clamp member mounted on the other of said data entry/interface mount and said linkage assembly and defining a first clamp opening, said first adjustment member received in said first clamp opening, said first clamp member having a clamped position in which said first clamp member is in clamped engagement with said first adjustment member and resists movement thereof, said first clamp member having a release position shifted from said clamped position, and in which said first adjustment member is moveable relative said first clamp member; and a first actuator assembly having a pivotable first handle mounted on said data entry/interface mount and a first flexible, movable cable coupled between said first handle and said first clamp member to selectively shift said first clamp member between said clamped position and said release position and at least one spring that engages said first clamp member for urging said first handle, said first cable, and said first clamp member toward said clamped position.

23. The support assembly of claim 22 wherein said spring extends between said first handle and said data entry/interface mount.

24. The support assembly of claim 22 having at least two springs, a first spring engaging said first clamp member, and a second spring extending between said first handle and said data entry/interface mount.

* * * * *